United States Patent [19]

Kelly et al.

[11] 4,128,065

[45] Dec. 5, 1978

[54] GENERAL PURPOSE INCINERATOR/COMBUSTOR

[75] Inventors: James F. Kelly; Edwin Johnson, both of Silver Spring, Md.

[73] Assignee: Materials Recovery Corporation, Silver Spring, Md.

[21] Appl. No.: 818,708

[22] Filed: Jul. 25, 1977

[51] Int. Cl.[2] ..... F23G 3/00

[52] U.S. Cl. ..... 110/211; 110/213; 110/244

[58] Field of Search ..... 110/203, 244, 246, 210–214, 110/295, 296; 432/72; 431/5

[56] References Cited

U.S. PATENT DOCUMENTS

| | | | |
|---|---|---|---|
| 1,697,268 | 1/1929 | Evesmith | 110/246 |
| 3,774,555 | 11/1973 | Turner | 110/210 |
| 3,780,676 | 12/1973 | Hazzard et al. | 110/212 |
| 3,792,670 | 2/1974 | DiNozzi | 110/213 |
| 3,806,322 | 4/1974 | Tabak | 431/5 |
| 3,861,330 | 1/1975 | Santoleri | 110/244 |
| 3,875,874 | 4/1975 | Altmann | 110/213 |
| 3,985,497 | 10/1976 | Fellnor et al. | 432/72 |
| 4,026,223 | 5/1977 | Robbins | 110/212 |

*Primary Examiner*—Henry C. Yuen

*Attorney, Agent, or Firm*—Jones, Tullar & Cooper

[57] ABSTRACT

An incinerator/combustor, comprising an elongated combustion chamber surrounded by an afterburner which is in turn surrounded by a housing, the afterburner and housing being coaxial with, and cooperating to provide redundant heating for, the combustion chamber, is disclosed. The combustion chamber is generally cylindrical with a horizontal axis, one end being adapted to receive materials to be burned. An ash chamber is spaced from the other end of the combustion chamber to define a circumferential opening which serves as an exhaust outlet. The two chambers are relatively movable to permit the flow of exhaust gases to be controlled. Air under controlled pressure is introduced to the combustion chamber to produce a cyclonic flow to enhance burning. A fuel supply may be provided to initiate combustion, but the system is designed to require no fuel other than the material being incinerated during normal continuous operation.

The afterburner extends over both the exhaust outlet and a major portion of the combustion chamber. Air under pressure directed across the exhaust outlet produces a Venturi effect to draw exhaust gases out of the combustion chamber and direct them into the afterburner. The outer housing receives exhaust gases from the afterburner and directs them back over the outside surface of the afterburner in a second redundant flow, carrying them to an outlet stack.

17 Claims, 5 Drawing Figures

FIG. 2
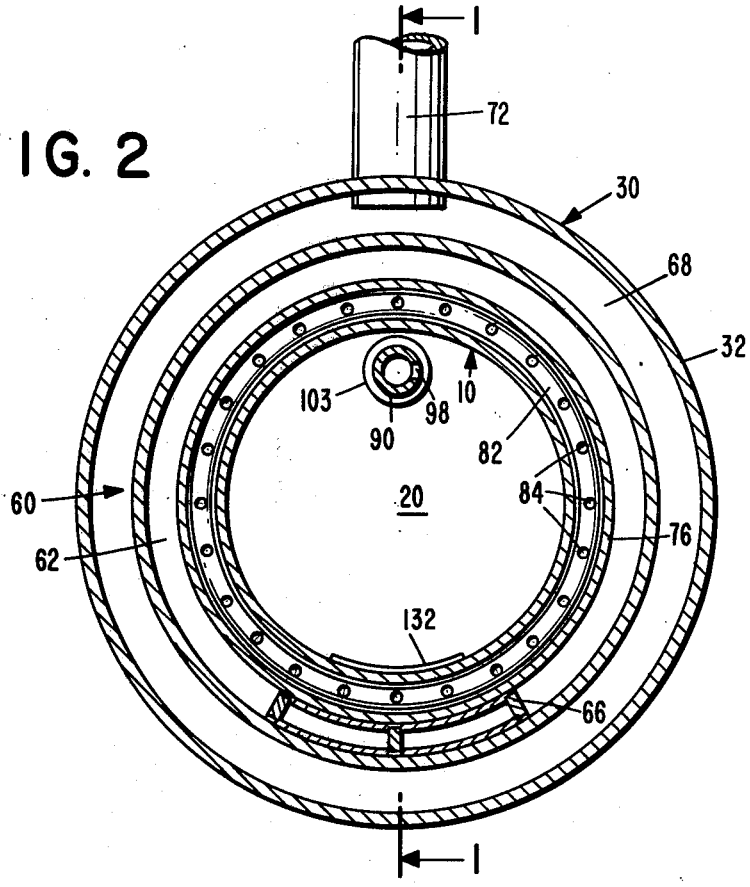
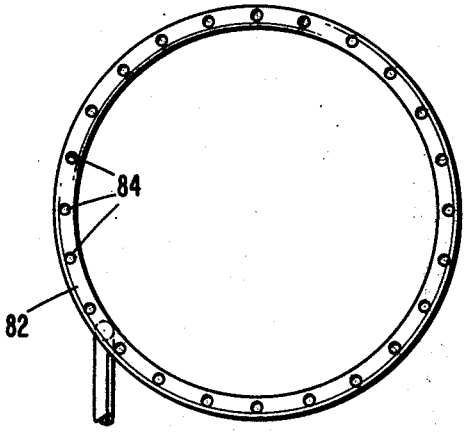
FIG. 3
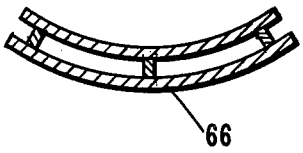
FIG. 4
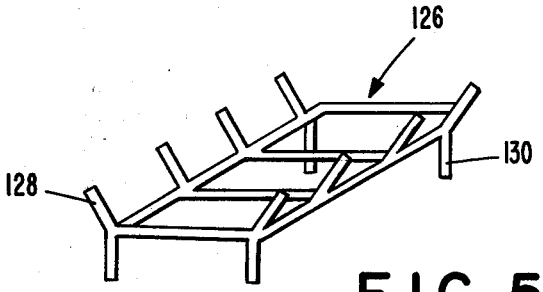
FIG. 5

GENERAL PURPOSE INCINERATOR/COMBUSTOR

BACKGROUND OF THE INVENTION

The present invention relates, in general, to combustors and incinerators, and more particularly to an improved incinerator structure which is designed to produce energy-efficient and pollution-free burning of organic fuels for the production of heat and the burning of waste materials for disposal of such materials.

Because of the growing recognition of and concern for the problems caused by burning organic fuels such as coal or waste materials which may include toxic chemicals or which may produce unpleasant or unsightly fumes and smoke as well as damaging exhaust gases, the development of an incinerator which is capable of producing complete combustion of such materials while emitting exhaust gases which meet or exceed government clean air standards is becoming of prime importance.

Extensive work and study, and large amounts of money, are being expended on the art and technique of combustion, and numerous advances have been made in the recent past. Many approaches to the design of incinerators have attacked the problem of incomplete combustion of waste materials through the use of large quantities of fuel, but this has lead to devices which are extremely wasteful by present standards, and such approaches are unsatisfactory in a time of declining fuel supplies. Thus, it is becoming necessary to develop incinerators that not only produce clean exhaust gases, but also are fuel-efficient standards which have in the past tended to be mutually exclusive. Similar problems are faced where the material to be burned is an organic fuel such as coal, where the primary purpose of the device is the production of heat rather than the disposal of waste material, for in such cases the clean air standards must still be met.

Since this is a highly developed field, and a wide variety of mechanical devices have been tried in an attempt to satisfy increasingly severe government standards, the prior art exemplifies the many diverse aproaches to combustion of waste material and organic fuels with each advance providing an improvement in a specified aspect of combustion devices. For example, the use of cyclonic flow in a furnace chamber is suggested in U.S. Patents such as No. 3,774,555 to Turner, and No. 3,792,670 to DiNozzi. These two patents, as well as Nos. 3,547,056 to Niessen and No. 3,870,676 to Hazzard et al disclose the use of afterburners in incinerators. A number of patents such as the Turner patent discussed above, and No. 3,706,445 to Gentry utilize a redundant flow where exhaust gases are used to heat incoming air while Patents such as No. 3,808,986 to Logdon suggest that by reflecting the heat produced through combustion within the furnace chamber can result in improved temperatures. Preheating of the inlet air is also suggested in U.S. Pat. No. 3,806,322 to Tabak.

In order to improve the mode of burning waste materials, some incinerators in the prior art operate on the batch process wherein a single load of waste material is placed in the incinerator, ignited and completely burned, after which a second load is placed in the incinerator and the process repeated. Examples of this procedure are illustrated in U.S. Pat. No. 3,491,707 to Bakker and 3,754,743 to Johnson. Another approach to the problem is illustrated in a large number of patents which utilize various conveyor means for carrying the materials through the furnace chamber of the incinerator in a continuous manner. An example of this is found in U.S. Pat. No. 3,924,548 to Chambon, wherein the waste material is fluidized by the inlet air flow and carried thereby through the incinerator. Other examples are found in U.S. Pat. Nos. 2,024,652 to Martel, 3,861,331 to Saitoh, et al, and 3,871,286 to Henriksen, all of which show various conveyor arrangements.

As illustrated by the foregoing patents, the art has approached the problems of combustion on a piecemeal basis, adding various features to existing devices and producing more and more complex and thus more expensive incinerators, without solving the dual problems of a pollutionfree exhaust and fuel efficiency.

SUMMARY OF THE INVENTION

The present invention overcomes the difficulties of the prior art through the provision of a new and improved structural arrangement for a combustor, and incinerator device, or furnace, which provides an efficient burning of material and which produces clean exhaust gases. To accomplish this efficiency, the incinerator of the present invention utilizes what may be termed a "quadraxial" geometry, providing a simple, yet efficient, structure that is relatively inexpensive, is easy to maintain, and which is easily adjustable to produce optimum burning conditions. Because of this quadraxial geometry, the exhaust gases generated by the combustion must travel a tortuous path which produces redundant heating of the combustion chamber. At the same time, these gases insulate the combustion chamber to prevent loss of thermal flux through radiation, the flow of exhaust gas resulting in a thorough commingling of the gases with the thermal flux. This commingling as the exhaust passes through a succession of concentric chambers which provide step-wise increases in the cross sectional area of flow maintains the high temperatures that are needed for clean burning without the need to add energy in the form of fuel to the afterburner stages which follow the main furnace chamber. The geometry of the present incinerator/combustor also permits close control of operating temperatures, simplifies adjustment of the exhaust gas dwell time in the fire zone within the combustion chamber as well as in the afterburner chamber and subsequent areas of the exhaust gas flow path and provides a controlled dynamic expansion of the exhaust stream to insure complete burning and efficient energy utilization.

The foregoing is accomplished through the provision of a combination combustor and incinerator which consists of an elongated, generally cylindrical combustion chamber which has a horizontal axis and which defines a centrally located fire zone where the material to be burned may be placed. Adjacent but spaced from one end of the combustion chamber is a second, coaxial, cylindrical ash chamber which receives material from the fire zone after burning. The space between these two chambers defines an exhaust outlet for the two chambers, whereby combustion products are directed into a circumferential, coaxial afterburner which surrounds the fire zone. The afterburner directs the exhaust gases along the outside surface of the combustion chamber so that the high temperature exhaust serves to heat the wall of that chamber. The exhaust also serves to insulate the combustion chamber wall to prevent heat loss through radiation, and any thermal flux that does radiate is mixed with the exhaust gas to assist in the final burning of pollutants in the exhaust. In addition, the interior surface of the afterburner wall reflects heat back toward the wall of the combustion chamber to further retain the heat of combustion.

The afterburner leads to a larger diameter, circumferential and coaxial furnace housing which directs the exhaust gases from the afterburner to an exhaust stack. This housing provides redundant heating for the wall of the afterburner. That is, the housing directs the exhaust gases along the outer wall of the afterburner to insulate that wall, to mix the exhaust gases with thermal flux radiated therefrom, and to reflect thermal flux back toward the afterburner. This provides additional improvements in the thermal efficiency of the combustion chamber by retaining the heat produced by the combustion and assisting in the maintenance of a high temperature in the afterburner for complete combustion. Since the four major elements of the incinerator, the combustion chamber, the ash chamber, the afterburner and the housing, are all coaxial, the geometry of the furnace may be referred to as being quadraxial.

The combustion chamber includes a source of fuel for initiating combustion, and a source of air which is fed under pressure in a tangential direction to produce a cyclonic burn within the fire zone. In addition, the spacing between the combustion chamber and the ash chamber is adjustable to vary the size of the exhaust outlet, the air pressure is variable to regulate the flow of oxygen to the fire, and the location of the material to be burned may be varied to control the burn temperature, these features permitting fine tuning of the incinerator to provide maximum combustion in the fire zone and afterburner.

In operation, the waste material or the fuel to be burned is placed in the fire zone by suitable means such as a conveyor to provide either batch or continuous feed. Initially a starter fuel is supplied to the combustion chamber along with air under pressure until the material to be burned ignites, at which time the starter fuel supply may be turned off, for most materials, and combustion of the material is maintained by proper adjustment of the furnace. Thus, the air flow, the size of the exhaust outlets, and the location of the material are adjusted to produce the desired helical and cyclonic burn within the fire zone with these factors affecting the dwell time of the exhaust; that is, the rate at which the exhaust gas moves out of the fire zone and into the afterburner, and the temperature of the burn.

When the desired temperature is reached, further adjustments to the size of the exhaust outlet, the rate of flow of the inlet air, or the location of the burn material may be made to maintain the desired temperature and minimize pollutants as the material is consumed. The exhaust flow into the afterburner is assisted by means of an auxiliary air source located adjacent the exhaust outlet and blowing thereacross to produce a Venturi effect which draws exhaust from the fire zone. This additional air produces further combustion within the afterburner as the exhaust gases flow along the outside surface of the combustion chamber, the exhaust gases finally entering the outer housing and flowing again in a redundant manner along the outside surface of the afterburner walls to the exhaust stack.

Upon completion of the desired amount of burning of the waste material, the residue is carried to the ash chamber where it is allowed to finish burning and then to cool and where it is eventually removed from the incinerator.

By careful adjustment of the incinerator, a high velocity cyclonic flow can be produced within the fire zone which produces a high shear and a high temperature without entraining the waste material or the ashes produced by the combustion. Further, by controlling the size of the exhaust outlet and the rate of flow from the auxiliary air supply in the afterburner and by proper design of the relative diameters of the afterburner and the housing with respect to the size of the combustion chamber and its exhaust outlet, the flow of exhaust gases is controlled so that the dwell time of the combustion products within the fire zone is regulated. The exhaust gas is then allowed to expand into the afterburner and into the housing in a controlled way so that any combustibles remaining in the exhaust gases may be burned in the afterburner to insure a pollution-free exhaust. The tortuous path of the exhaust gases as they are carried along the outer surface of the combustion chamber to insulate the fire zone and the tortuous path of radially directed thermal flux, caused by the multiple reflections of the coaxial walls, reduce the costs of the furnace by permitting elimination of refractory materials and, at the same time, increasing the thermal efficiency of the device so that the temperatures of combustion are reached more quickly and may be maintained without the use of supplemental fuel. Additional control of the temperature reached within the furnace can be obtained by regulating the quantitiy of material placed in the fire zone, by selection of the temperature level at which one batch of material is replaced by another, or by selection of the rate at which material is supplied in the case of a continuous feed operation. The design permits very high temperatures to be reached and maintained, again without the need for supplemental fuel, adding to the efficiency of the system.

The cyindrical design of the system lends itself to the use of conveyors for continuous processing as well as to the use of carriers for batch type processing. Further, the controllability of the exhaust flow permits the unit to be operated with both ends open to the atmosphere without gases leaking out to present a hazard to the operator. The proper operation of air flow and exhaust outlet size permits maintenance of a negative pressure at the feed end of the furnace chamber so that the doors can be opened and waste material or fuel can be fed into the unit and ashes removed therefrom without danger.

The furnace preferably is of an all metal construction, assembled without welding, for simplicity and ease of construction and maintenance. However, other materials such as ceramics may be used if corrosion of the various elements becomes a problem; however, it is preferred that such other materials be thermally conductive to insure proper operation of the unit in the manner described above. The heat conductive properties of the furnace material together with the geometry of the quadraxial design provide a fixed thermal flux pattern wherein most of the heat radiated from the combustion chamber is directed into the afterburner, with only a relatively small amount of the thermal flux being radiated from the ends of the structure.

The unit is capable of burning solids, liquids or gaseous materials and functioning as either an incinerator for disposal of waste or as a combustion where its principal function is the production of heat. The residue from such material may be conventiently recovered in the ash chamber. The various features described are obtained with a relatively small and light weight furnace unit that is relatively inexpensive to build and to operate, and which lends itself to automatic or microprocessor control. Further, the unit is easy to disassemble and to maintain and may be made in a variety of sizes and capacities without departing from the basic quadraxial design, diameter ratios, and length-to-diameter proportions.

BRIEF DESCRIPTION OF THE DRAWINGS

The foregoing and additional objects, features and advantages of the invention will become evident to those of skill in the art from a consideration of the following detailed description of a preferred embodiment, taken in conjunction with the accompanying drawings in which:

FIG. 2 is a cross sectional view of the furnace of FIG. 1, taken along lines 2—2 of FIG. 1;

FIG. 3 is an end view of the afterburner air injector;

FIG. 4 is a cross sectional view of a support bracket used in supporting the combustion and ash chambers; and FIG. 5 is a perspective view of one type of material holder for receiving material to be burned.

DESCRIPTION OF A PREFERRED EMBODIMENT

Figure 1:
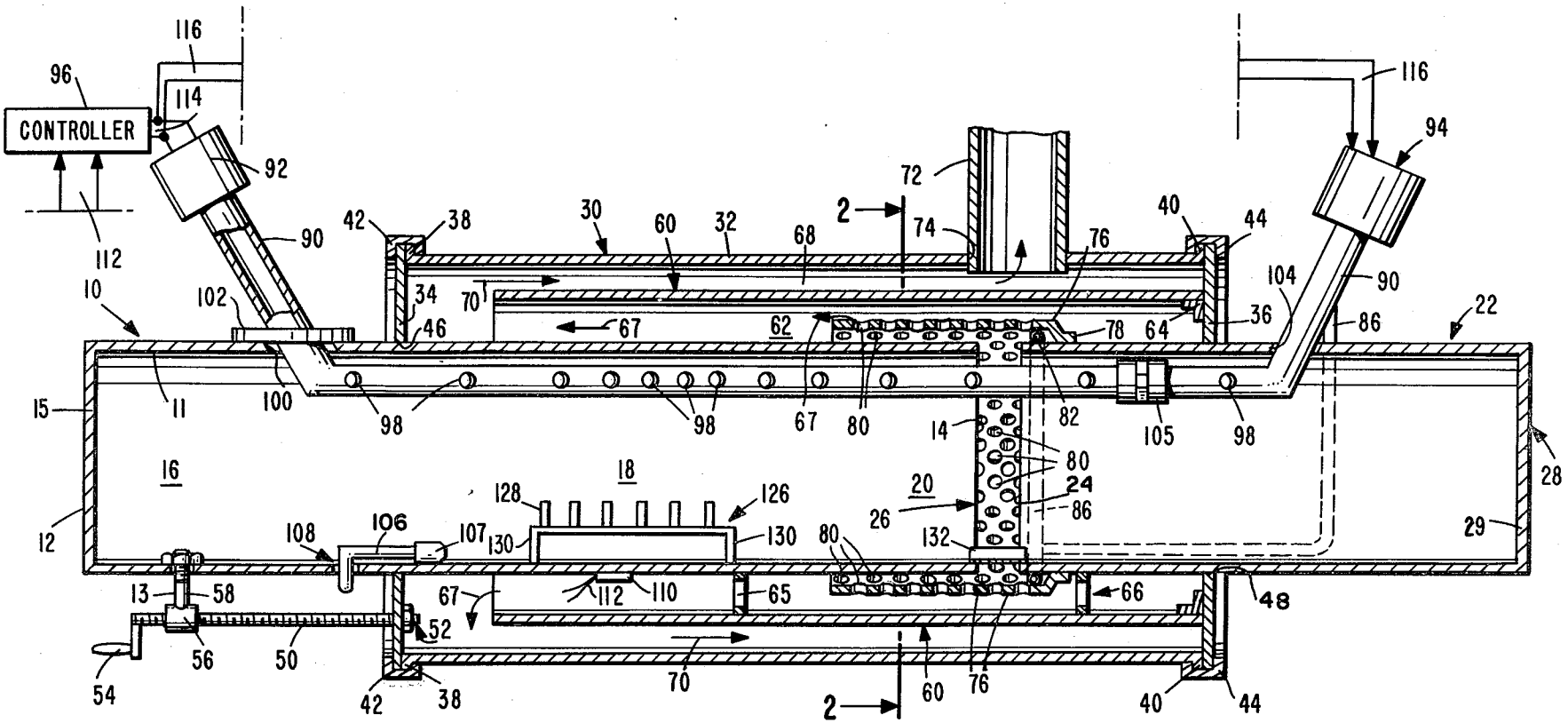
FIG. 1 is a cross sectional view of an incinerator/-combustor constructed in accordance with the present invention.

Turning now to a more detailed description of the present invention, there is illustrated in FIG. 1 an incinerator/combustor constructed in accordance with the present invention and which, for convenience, will be referred to as a furnace. The furnace incorporates a combustion chamber 10 which is preferably a right circular cylinder constructed of a suitable heat-conductive material such as light gauge stainless steel, inconel or other high temperature alloy, a ceramic material or the like. The chamber 10 has a cylindrical outer wall 11 with a generally horizontal axis and first and second ends 12 and 14, the first end preferably being closed by a suitable entrance closure wall 15 carrying a door or the like (not shown) through which material to be burned can be placed within the fire chamber. The door may be adapted to admit waste material in batches by means of suitable containers, in a continuous flow by way of suitable endless conveyors, or in other conventional ways. The second end of the chamber is open to permit removal of combustion residues such as ashes and also to form a part of the exhaust gas outlet for the incinerator. The elongated combustion chamber 10 thus defines an inlet or feed zone 16 located in the vicinity of the entrance door, a fire zone 18 generally located in the midportion of the combustion chamber, and an exhaust zone 20 located near the end 14 of the chamber 10.

Axially aligned with the combustion chamber is an ash chamber 22 which is also preferably cylindrical, having an equal diameter to that of the fire chamber and being constructed of the same material. The ash chamber has a first, or inlet end 24 which is spaced from and cooperates with the outlet end of the combustion chamber to define an annular exhaust port or opening 26. The second end 28 of the ash chamber may be closed by a suitable end wall 29 carrying a door (not shown) through which residues of the combustion process may be removed after the waste material has been burned and the ashes cooled.

Chambers 10 and 22 are mounted in end-to-end relationship within an outer housing 30 which also is preferably cylindrical, and which is coaxial with the two chambers. The housing 30 includes a cylindrical side wall 32 and first and second end walls 34 and 36, the side wall being formed with circumferential end flange portions 38 and 40, respectively, so that they may be secured to the end walls by suitable rim clamps 42 and 44, respectively. The end wall 34 includes a central opening 46 which is adapted to receive the combustion chamber 10 and to support that chamber in a coaxial position within the housing. As indicated, chamber 10 extends sufficiently far into the housing that the housing will encompass at least the fire zone 18 and the exit zone 20 of the combustion chamber, the remainder of chamber 10 extending out of the housing for easy access to the feed zone and to permit connection of air and fuel inlets to be described.

A centrally located opening 48 in the end wall 36 of the housing 30 provides support for ash chamber 22 whereby that chamber extends into the housing coaxially with the combustion chamber. Again, a substantial portion of the ash chamber extends out of the housing for easy access and to permit cooling of the residue as well as to provide space for the connection of an air supply.

The combustion and ash chambers are mounted within the housing for relative motion aong their common axis so that the size of the annular exhaust outlet 26 may be varied to produce the desired burn conditions within the fire zone. This adjustability may be obtained in a variety of ways, for example, by means of a worm gear 50 having one end rotatably mounted in a journal 52 mounted in wall 34 and the other end carrying a hand crank 54. Mounted on the worm gear for axial motion upon rotation of the gear is a slide element 56 which is secured by means of a bracket 58 to the combustion chamber 10, whereby rotation of the handle 54 causes the slide element 56 and bracket 58 to move lengthwise along the worm gear, carrying with it the fire chamber 10. It will be apparent that a similar arrangement could be provided for the ash chamber, and that such adjustment mechanisms may be motor-driven for automatic control of the outlet port dimensions.

Secured within the annular space defined between the combustion chamber 10 and the outer housing 30 is an inner casing 60 which defines an afterburner section 62 surrounding chamber 10. The afterburner casing is secured by suitable means such as brackets 64 which may be bolted to the end wall 36 of housing 30. Casing 60 extends coaxially with the chambers 10 and 22 from end wall 36 toward end wall 34 of housing 30, thereby defining an annular afterburner which surrounds at least the outlet portion 20 and the fire zone 18 of the combustion chamber. For stability, the free ends of the fire and ash chambers 10 and 22 may be supported by suitable brackets 65 and 66 mounted within the afterburner casing 60. Additional support brackets may be provided as required, the number and location depending upon the size of the furace and thus of the relative weights and diameters of the various chambers, casing and housings.

The afterburner casing 60 receives exhaust gases from the fire zone 18 and from the ash chamber 22 by way of the exhaust outlet 26, directing these gases along the outside surface of the side wall 11 of the combustion chamber in the direction of arrow 67. When the exhaust gases reach the end of the afterburner casing, they turn outwardly and move in the opposite direction into a cooling zone 68 defined by the annular space between the afterburner casing 60 and the outer housing 30. The gases in this zone move in the direction of arrow 70 toward an exhaust stack 72 secured in an opening 74 located in the surface of housing 30. The exhaust stack leads to a suitable flue, which preferably incorporates an exhaust fan, or a tall chimney to provide the required draft for the incinerator/combustor. The flue or chimney may include suitable heat exchangers, scrubbers and the like to treat the exhaust from the furnace.

In the preferred form of the invention, the relative diameters of the fire chamber, the afterburner casing, and the outer housing are selected so that the cross sectional area of the afterburner is greater than the area of the exhaust outlet 26 and so that the cross sectional area of the cooling chamber 68 is greater than that of the afterburner, whereby the exhaust gases move through a series of flow paths of increasing area, permitting the gases to expand as they move toward the exhaust stack. This controlled expansion not only improves the combustion of the exhaust gases, but insures a reduction in pressure which causes the gases to flow freely toward the exhaust stack.

The exhaust gases produced by the burning of any material, such as fuel for heating purposes or waste material for disposal or for recovery of constituents, may include not only gases, but vapors, particulate matter, entrained material, and the like, all of which contribute to the pollution of the atmosphere if discharged directly from the combustion chamber to the open air. Accordingly, the afterburner portion of the present furnace is provided to induce additional burning of these pollutants, which are broadly referred to herein as exhaust gases. To insure complete combustion of these pollutants in the afterburner, a baffle, or diffuser, 76 is provided to produce a turbulent flow that will thoroughly mix and heat the exhaust gases. The baffle is cylindrical and coaxial with the combustion chamber and the ash chamber, and is secured, for example, to the outer surface of the ash chamber by means of a suitable flange 78 and securing bolts (not shown). The baffle is formed with a large number of perforations such as the small circular holes 80, the holes being of such a size and being so spaced as to occupy approximately 50 percent of the surface area of the baffle.

To further increase the turbulent flow and to improve the combustion of the exhaust gases, including any material carried thereby, an afterburner air supply manifold 82 is provided within the diffuser 76 and adjacent the exhaust opening 26. The air manifold 82 surrounds the ash chamber 22 adjacent the edge of inlet end 24 and is provided with a plurality of openings 84 (see FIG. 3) which are directed to supply a flow of air axially within the baffle 76 and thus across the exhaust opening 26. This axial flow of air produces a Venturi effect across opening 26, producing a slight negative pressure at the annular exhaust opening which serves to draw exhaust gases out of chambers 10 and 22 and into the afterburner by way of the baffle 76. Air is supplied to manifold 82 by way of air inlet supply pipe 86 from a main air supply manifold 90 which extends through the fire zone 18 within the combustion chamber 10.

Air manifold 90 is an elongated tube which extends into chambers 10 and 22 and which receives air from pumps 92 and 94. These pumps are conventional variable speed electric blowers operated under the control of a conventional control circuit 96 which may be either manually or automatically varied in accordance with the requirements of the fire in the combustion chamber. The air supplied by blowers 92 and 94 is fed by way of manifold 90 to a plurality of air supply apertures or nozzles 98 located in the side wall of the manifold. These air inlet openings are directed tangentially to the wall of combustion chamber 10 to provide a helical flow of air within the fire zone 18. As indicated diagrammatically in FIG. 1, the air inlets 98 are spaced along the length of the manifold, extending from the feed portion of the fire chamber 10 into the ash chamber 22, the inlets being spaced along the manifold in such a way as to provide the desired air flow characteristics. Thus, for example, the majority of the air inlets are located in and adjacent the fire zone 18 and in the outlet zone 20 to provide maximum combustion in these areas, while only a relatively few openings are provided at the feed end of the fire chamber and in the ash chamber. Although the exact spacing of the air inlets is not critical, it will be apparent that the largest flow of air is required in the combustion zone 18 and the outlet, or exhaust, zone, and that the inlets should be directed to provide a tangential flow angled toward the outlet so that cyclonic burning occurs in the fire zone and so the air flows toward the outlet.

As illustrated in the drawing, the air supply is furnished from a source such as the ambient atmosphere outside the fire chamber, with the manifold 90 passing through a slot 100 formed in the wall of fire chamber 10. This slot is elongated to permit axial motion of the fire chamber for adjustment of the size of the exhaust port 26, with the slot 100 being closed by a suitable cover plate 102 to prevent the escape of exhaust gases. Similarly, the opposite end of the exhaust manifold 90 extends through an opening 104 in the ash chamber 22 to permit connection to blower 94. A suitable coupling 105 may be provided in the manifold to facilitate assembly and disassembly of the unit. It will be apparent that only one blower may be required in some embodiments of the invention, in which case the manifold need not extend out of the ash chamber 22.

As indicated, the afterburner manifold 82 receives its air supply from supply line 86 which preferably is connected to manifold 90 so that it also receives its air under the same pressure as is provided in manifold 90 from blowers 92 and 94. This has the advantage of permitting preadjustment of the air supply ratio between the combustion chamber and the afterburner and provides an automatic proportional change in one rate when the other is varied. Such a connection, together with the preselection of the number of air outlets in the two manifolds, assures that the desired balance of air will flow in the combustion chamber and the afterburner. However, it will be apparent that a separate blower may be provided for the afterburner manifold, if desired, to allow independent control of the afterburner, but adjustment of the fire is more difficult. It will be noted that air outlets are also provided in the ash chamber 22 to insure complete combustion of the burn residue when that material is shifted from the fire zone to chamber 22.

Also located within the fire zone 18 of the fire chamber 10 is a fuel supply line 106 which extends through an aperture 108 in the side wall of the fire chamber. This line and its nozzle 107 is provided to supply fuel such as oil or gas for use in igniting the material to be burned. A thermocouple 110 may be mounted at a convenient location on the wall 11 of chamber 10 at or near the fire zone 18 and may be connected by way of leads 112 to the controller 96 which may respond to this input and to other control signals to regulate the operation of the blowers 92 and 94 by way of lines 114 and 116.

Although a variety of conveyors may be provided within the incinerator and extending through the length of the fire chamber and the ash chamber to carry waste material to be burned, for purposes of illustration the waste material container is shown as being a burn basket 126. This basket has side supports 128 and rests on legs 130 which serve to space the material carrier from the side wall 11 of the combustion chamber. The burn basket may be positioned in the fire zone by means of a long-handled carrier, or may itself be carried through the unit by a suitable conveyor. To facilitate passage of the burn basket from the fire zone 18 to the ash chamber 22 after the material has been incinerated, a plate 132 is secured to one or the other of the chambers and extends across the exhaust outlet, providing a bridge over which the burn basket may pass.

To operate the above described incinerator, ignition fuel such as propane gas is fed to the spray nozzle 107 and is ignited in conventional manner. The variable speed air blowers 92 and 94 are then turned on to supply air under pressure to the combustion chamber, the rate of flow being regulated by controller 96. A burn basket containing the material which is to be burned is then placed in the fire zone 18 at the approximate position illustrated; that is, in approximately the longitudinal center of the combustion chamber, within the area surrounded by the afterburner and the outer housing so that these outer cylinders will provide reflective surfaces for the thermal flux radially directed outwardly from the fire zone. As the solid material begins to ignite, the speed of the air blowers 92 and 94 is adjusted either manually or automatically so as to produce an air flow within the fire chamber which minimizes the opaque smoke produced by the fire.

When the waste material has ignited and reaches a temperature where combustion is self-sustaining, the fuel supplied by fuel line 106 may be turned off and, in normal continuous operation of the combustor, no further auxiliary or ignition fuel need be supplied, unless the material being burned does not contain enough energy to support combustion. In this latter case, it may be necessary to supply some auxiliary fuel, the amount required being dependent on the nature of the material being burned. However, it has been found that even where such auxiliary fuel must be supplied, considerably less fuel is required than has been the case with prior furnaces.

The thermocouple 110 monitors the temperature of the burn chamber and its output, together with the outputs from other conventional monitors, may be used for automatic control, where desired. As the wall temperature in the combustion chamber 10 approaches the desired operating temperature, the blowers are adjusted to hold the temperature within a desired range. For example, in a test of a combustor made in accordance with the present invention, medical X ray film was incinerated and it was found that an operating temperature of between 1600° F. and 1800° F. was required. This temperature can vary, however, with other materials, with variations in the quantity of material supplied to the combustion chamber, with the length of time the material remains in chamber 22, with the time between batches of material, with the location of the burn material in the chamber, and other such factors, as well as the flow rate of the air supply.

When the combustor reaches its operating temperature, the operator may make final adjustments of the air supply blowers 92 and 94, adjust the position of the burn basket 126, and adjust the size of the outlet port 26 so as to minimize air pollution, visible exhaust, smoke and ash. This involves an adjustment for the fastest burn rate that can be obtained without causing smoke, and is a function of the wall temperature within the burn zone and the amount and type of material placed in the burn basket. Again, it will be apparent that these adjustments may be carried out automatically under the control of controller 96, or may be done manually by an operator. In addition, it will be apparent that the exact adjustments will depend upon the nature of the material being burned, and will vary with the rate of feed of the material through the incinerator.

During the burning of the material in chamber 10, the air supplied by manifold 90 flows into the combustion chamber in a direction tangential to the cylindrical wall of the chamber to cause a vigorous cyclonic flow which produces a reduced pressure at the center of the fire zone to improve the release of gases from the material being burned. These gases are caught up in the high speed shear forces of the cyclonic flow, and travel in a helix from the fire zone 18 toward exit port 26, with the pitch and velocity of the helix being controlled by the rate of flow of the air entering the chamber, the size of the exhaust port 26, the temperature within the chamber, and similar factors.

When the door to the furnace is opened, the helical flow causes fresh air to be drawn into the center of the vortex produced by the cyclonic flow, thus feeding the air directly to the burning material and improving the burn rate.

It will be noted that the air supply manifold 90 is spaced away from the side wall of combustion chamber 10. This location is important in that it causes a circular standing wave of turbulence in the fire zone which assists combustion. Also, in this location the manifold does not impede the high velocity air and gases which flow around the outer periphery of the fire zone. The high angular motion of these gases helps to force the exhaust gases through the exhaust port 26 and further assists in keeping a slight negative pressure inside the fire chamber.

The exhaust gases from the fire zone flow along a helical path toward the exhaust port at a rate determined by the various conditions within the combustion chamber. The length of time these gases remain in the combustion chamber is referred to as the dwell time, and this may be varied to effect the desired burn characteristics. The air flow from manifold 82 causes a Venturi effect across the exhaust port 26 to aid in drawing the exhaust gases out of the fire zone 18. The Venturi effect, the burning that occurs in the afterburner, the helical flow in the fire zone 18 and the use of a blower in the chimney or exhaust flue all serve to create a slight negative pressure inside the fire chamber 10 in the area of the inlet 16 so that the doors to the combustor may be opened without endangering the operator; in fact, if desired, the combustor may be operated without an end door, for the negative pressure within the fire zone prevents exhaust gases from flowing toward the feed zone 16.

The exhaust gases enter the afterburner through the baffle 76, which, together with the air flow from auxiliary source 82, creates a turbulent flow in the gases to improve the mixture of the gas and air to complete the combustion of the gases as they are carried along the outer surface of the wall 11 of combustion chamber 10. The high temperature exhaust gases flowing along the wall 11 help heat that wall and also serve to insulate it against the loss of radially-directed heat flux, thereby helping to maintain the desired high temperature within the fire zone 18. The afterburner casing 60 reflects heat flux radiated by the combustion chamber, and is also heated by the exhaust gases to radiate heat inwardly toward chamber 10, thus adding to the maintenance of the desired high temperature within the combustion chamber. The continuing high temperature within the afterburner also effects complete combustion of any materials remaining in the exhaust gases, thus contributing to a pollution free exhaust.

As the gases leave the afterburner, they are further expanded into the exit chamber 68, where they give up additional heat to the outer housing wall 30 and to the afterburner casing 60. In addition, the gases insulate the afterburner casing against outwardly radiated heat flux, and the housing wall reflects a part of that heat flux inwardly, thereby helping to maintain the desired temperature in chamber 10. Heat given up to the outer housing 30 is radiated both inwardly and outwardly, the inward radiation serving to conserve heat within the furnace and outward radiation serving to effect cooling of the exhaust gases. The outer housing 30 may be cooled by means of fans or the like directing cooling air against the outer walls or, if the unit is to serve as a heat source, the radiated heat may be used in conventional manner.

The tortuous path followed by the exhaust gases has an increasing cross-section of area which provides an easy flow of exhaust gas and to insure complete combustion of any residue in the exhaust. This path also produces a smooth, continuous thermal change along the length of the flow path which serves to maintain the temperature of the fire zone while also cooling the exhaust gases, all in a controlled manner. Most of the heat energy released during burning is used many times over to provide a redundant heating as the exhaust gases follow the exit path through the afterburner and the outer housing, and as the radiated thermal flux is reflected back toward the center of the combustion chamber, with the result that the fire zone remains at a high, controllable temperature and provides a fast burn rate while keeping the exhaust gases and air-borne particulates in a very high temperature environment for a long dwell time to insure thorough combustion.

The exhaust gases which reach the exhaust stack 72 preferably are further processed by cooling in suitable heat exchangers, cooling by means of a suitable water spray into the stream, may be scrubbed in suitable air pollution control scrubbers, may be passed through electrostatic precipitators, or other filters, or the like as required by government regulations and air quality standards. However, because of the low level of pollutants in the exhaust from the present combustor and the relatively low temperature of the exhaust for devices of this type, conventional devices may be used in the exhaust stack, without overloading them and without the need for special designs.

When waste material is being incinerated, either with or without the use of auxiliary fuel, the temperature of the fire zone will reach a stable peak, and then drop off as the material burns. When the temperature reaches a selected lower value, such as 1200° F. for the X ray film described above, the burn basket is moved to the ash chamber 22, and a second burn basket is placed in the fire zone. Even if auxiliary fuel is being used, the temperature still will drop off for most waste materials, since most of the heat of combustion will be produced by the material being burned, rather than by the fuel.

If the waste material in the second burn basket is substantially the same as the material previously burned, the hot walls of the fire chamber will automatically ignite the newly supplied waste material and the process will continue as before. Again, suitable adjustments may be made to the air supply and to the exhaust outlet 26 where required, although after the system has reached a continuous operation, further adjustments usually will not be needed. While the material in the fire zone 18 is igniting and burning, the burning of the ash and residue from the first burn basket will be completed in the ash chamber 22 and may be removed after a suitable period of cooling. The air supply manifold 90 provides air to chamber 22 to support the combustion of this residue, and the resulting exhaust gases are carried out the exhaust port 26 for burning in the afterburner.

A model of the present combustor was constructed and was found to produce the highly improved results discussed above. In this model, the diameter of the fire chamber 10 was 14 inches and its length was 42 inches, the chamber extending about 24 inches into the housing 30. The diameter of the afterburner casing 60 was 18 inches and its length was about 28 ½ inches. The diameter of the outer housing 30 and 23 inches and its length was 35 inches, and the diameter of the baffle 76 was 16 inches with its length being 12 inches. The ash chamber was 28 inches long and extended about 9 inches into the housing 35, leaving the exhaust port about 2 inches wide. It was found that this ratio of diameters produced a highly effective incinerator, and that any large deviation of one diameter without a corresponding change in the others degraded the operation and resulted in a smoking condition which could not be corrected by other adjustments. The length to diameter ratios were not as critical, and could be varied to regulate the exhaust gas path and the dwell time for the gases in the combustion chamber. Thus, a lengthening of the combustion chamber and the afterburner, for example, results in a longer gas path, improved heat exchange and cooler exhaust gases, but increases the impedance to flow and thus adversely affects the fire zone. the length of diameter ratios must be optimized to maintain proper flow and utilization of the gases, and the dimensions illustrated above have been found to give good results.

Although a preferred embodiment of the invention has been disclosed, it will be apparent that numerous variations can be made without changing the basic geometry and operation of the system. Thus, for example, two or more combustors could be placed in series on a common axis to increase the burn rate on a single conveyor system, doors could be placed on the bottom of the ash chamber to speed removal of debris and other accumulations, and a heat exchanger could be provided for the wall of the main housing 30 to assist in the removal of heat to permit an increase in the burn rate and to help pump the exhaust gases through the system by cooling them as they move toward the exit stack. In addition, fuel may be added to the afterburner or to the air manifold 82 to improve combustion in the afterburner, and the fuel supply through nozzle 106 may be continued in circumstances where the material to be incinerated is not self-burning; i.e., where material such as sewer sludge or waste material such as halogenated hydrocarbons are to be burned.

Thus, there has been disclosed a new and improved incinerator furnace for use in burning a variety of fuels and waste materials, whereby the waste materials may be reduced in volume for disposal or recovery of valuable substances such as gold or silver and for recovery of energy, in a small, light-weight, inexpensive and easily maintained and repaired processor. The device is small in size, low in initial costs and in operating costs, and has a greatly reduced output of pollutants. Although the invention has been described in terms of a preferred embodiment, it will be understood that the true scope thereof is limited only by the following claims.

We claim:

1. A multi-fuel incinerator, comprising:

an elongated combustion chamber having a generally horizontal axiz and having first and second ends, said combustion chamber defining a centrally located fire zone;

an ash chamber having a generally horizontal axis and first and second ends, said ash chamber being coaxial with said combustion chamber and axially spaced therefrom to define a circumferential exhaust outlet;

means for varying the spacing between said combustion chamber and said ash chamber to vary the size of said exhaust outlet;

an afterburner casing coaxial with and coextensive with at least the fire zone portion of said combustion chamber and surrounding said exhaust outlet;

baffle means within said afterburner and surrounding said exhaust outlet;

means for supplying air under pressure to said fire zone in a direction to create a vortex flow within said fire chamber; and means for placing materials to be burned in said fire zone.

2. The incinerator of claim 1, further including housing means coaxial with and surrounding said afterburner, said housing directing exhaust from said afterburner along the exterior thereof.

3. The incinerator of claim 2 further including a stack outlet leading from said housing, and wherein said afterburner causes exhaust gases to flow along the outer surface of said combustion chamber and said housing receives exhaust gases from said afterburner and directs such gases along the outer surface of said afterburner to said stack outlet thereby providing a tortuous, counterflow path for exhaust gases and providing redundant heating for said fire chamber and said afterburner.

4. The incinerator of claim 3, wherein the walls of said combustion chamber, afterburner, and housing are constructed from a thermally conductive material.

5. The incinerator of claim 4, wherein the diameters of said combustion chamber, afterburner and housing are such that the cross-sectional area of said tortuous path increases in steps from said exhaust outlet to said stack outlet to cause exhaust gas to expand as it flows out of said incinerator.

6. The apparatus of claim 1, further including means for supplying air under pressure to said afterburner.

7. The apparatus of claim 6, wherein said last mentioned means comprises a source of air adjacent said exhaust outlet to direct air across said outlet and along said afterburner.

8. The apparatus of claim 7, wherein said source of air adjacent said exhaust outlet produces a negative pressure effect at said outlet to draw exhaust gases from said combustion chamber.

9. The apparatus of claim 1, wherein said combustion chamber, ash chamber, and afterburner are cylindrical.

10. The apparatus of claim 1, wherein said means for supplying air under pressure to said fire zone comprises an air supply manifold extending into said combustion chamber, a source of air connected to said manifold, and outlet ports in said manifold for directing air into at least said fire zone.

11. The apparatus of claim 10, wherein said outlet ports in said manifold are so directed as to produce a cyclonic flow of air in said fire zone.

12. The apparatus of claim 11, wherein said air supply manifold extends through said fire zone, and is spaced from the walls of said fire chamber to facilitate said cyclonic flow.

13. The appartus of claim 10, wherein said combustion chamber includes a feed zone, a fire zone, and an outlet zone, said outlet zone being adjacent said exhaust port, and wherein said air supply manifold extends through at least said fire zone and said outlet zone to supply air thereto.

14. The apparatus of claim 13, wherein said air supply manifold extends into said ash chamber and includes air outlet ports for directing air thereto.

15. The apparatus of claim 14, further including means connected to said air supply manifold for supplying air under pressure to said afterburner.

16. The apparatus of claim 1, further including means for varying the rate of flow of air to said fire zone.

17. The apparatus of claim 1, further including a housing surrounding said afterburner casing and adapted to provide redundant heating for said afterburner, wherein said combustion chamber, baffle means, afterburner casing and housing are cylindrical and coaxial and have diameters approximately in the proportion 14 : 16 : 18 : 23, respectively.

* * * * *